US009086660B2

(12) United States Patent
Akamatsu et al.

(10) Patent No.: US 9,086,660 B2
(45) Date of Patent: Jul. 21, 2015

(54) IMAGE FORMING APPARATUS WITH MODIFIED TRANSFER BRUSH

(71) Applicant: CANON KABUSHIKI KAISHA, Tokyo (JP)

(72) Inventors: Takaaki Akamatsu, Yokohama (JP); Kenichi Ogawa, Kawasaki (JP); Koji An, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/093,714

(22) Filed: Dec. 2, 2013

(65) Prior Publication Data

US 2014/0161496 A1 Jun. 12, 2014

(30) Foreign Application Priority Data

Dec. 11, 2012 (JP) ..... 2012-270666
Dec. 11, 2012 (JP) ..... 2012-270667
Aug. 9, 2013 (JP) ..... 2013-166438

(51) Int. Cl.
*G03G 15/16* (2006.01)

(52) U.S. Cl.
CPC .... *G03G 15/1685* (2013.01); *G03G 2215/1642* (2013.01)

(58) Field of Classification Search
CPC ..... G03G 15/1665; G03G 15/1685; G03G 2215/1642
USPC ..... 399/313, 175, 302, 308; 361/221, 225
See application file for complete search history.

(56) References Cited

U.S. PATENT DOCUMENTS 5,245,386 A 9/1993 Asano et al.
5,568,231 A * 10/1996 Asano et al. ..... 361/225 X
6,134,415 A * 10/2000 Iwakura et al. ..... 399/313 X
7,813,685 B2 * 10/2010 Ishii ..... 399/313 X
2011/0318069 A1 * 12/2011 Nishizawa ..... 399/308

FOREIGN PATENT DOCUMENTS

JP 4-274464 A 9/1992
JP 2001-134115 A 5/2001
JP 2006-154155 A 6/2006

* cited by examiner

*Primary Examiner* — Sophia S Chen
(74) *Attorney, Agent, or Firm* — Fitzpatrick, Cella, Harper & Scinto

(57) ABSTRACT

The image forming apparatus includes an image bearing member adapted to bear a toner image, a transfer belt configured to be movable, and a transfer device positioned across the transfer belt from the image bearing member and adapted to transfer the toner image from the image bearing member to the transfer belt. The transfer device includes a brush member equipped with a plurality of conductive filaments to be put into contact with the belt, wherein the plurality of conductive filaments located at an upstream end with respect to a moving direction of the transfer belt is cut along an orthogonal direction intersecting the moving direction of the transfer belt at right angles or the conductive filaments located at an upstream end of the brush member along the moving direction of the transfer belt are bonded together.

17 Claims, 10 Drawing Sheets

IMAGE FORMING APPARATUS WITH MODIFIED TRANSFER BRUSH

BACKGROUND OF THE INVENTION

1. Field of the Invention

The present invention relates to an electrophotographic image forming apparatus.

2. Description of the Related Art

Conventional image forming apparatus such as copiers and printers which use an electrophotographic method include a type which uses an intermediate transfer belt. An image forming apparatus of an intermediate transfer belt type forms a full-color image through a primary transfer process and secondary transfer process. In the primary transfer process, a toner image formed on a surface of an electrophotographic photosensitive body is transferred onto the intermediate transfer belt. This process is repeated for toner images of plural colors, thereby forming toner images of the plural colors on the surface of the intermediate transfer belt. In the secondary transfer process, the toner images of the plural colors are transferred altogether onto a surface of a transfer material such as paper. The toner images transferred onto the surface of the transfer material are fixed by a fixing unit. This produces a full-color image.

A roller-typed, blade-typed, or brush-typed transfer member is used as primary transfer members of the image forming apparatus. The transfer member is used for contacting a back surface of the intermediate transfer belt at a position opposite the photosensitive body, with a primary transfer voltage applied thereto. Among others, the brush-typed transfer member is made up of a conductive filament group, and each and every one of the filaments can independently come into contact with the back surface of the intermediate transfer belt. This remedies uneven contact caused when a roller type or blade type transfer member is used and enables more uniform contact with the back surface of the intermediate transfer belt. This properly reduces image defects such as density unevenness occurring in the primary transfer process.

As a method for coming into contact with the back surface of a belt of a brush-typed transfer member, Japanese Patent Application Laid-Open No. 2001-134115 discloses a method for coming into contact with the belt by tilting the transfer member such that filaments will come into contact with the back surface of the intermediate transfer belt by being inclined downstream in a moving direction of the belt. With this contact method, an inclination direction of the filaments can be limited to a direction toward a downstream side of the moving direction of the belt.

However, in the moving direction of the belt, the upstream side of the brush-typed transfer member is sometimes inclined randomly. It is necessary that an upstream end of the brush-typed transfer member is placed at a predetermined position relative to an upstream end of a contact area between a photosensitive drum and the intermediate transfer belt. If the position of the upstream end of the brush-typed transfer member is displaced from the contact area, there is a fear that an electric discharge might occur upstream of the contact area, degrading primary transfer property.

In particular, with the brush-typed transfer member, plural conductive filaments located at an upstream end are often randomly oriented. Consequently, even if the brush-typed transfer member is positioned accurately with respect to the contact area, positions at which the conductive filaments at the upstream end come into contact with the intermediate transfer belt might vary with respect to a direction orthogonal to the moving direction of the intermediate transfer belt, resulting in degradation of primary transfer property.

Note that, this problem occurs not only in the image forming apparatus which use an intermediate transfer belt as a transfer belt, but also in image forming apparatus which use a transport belt adapted to transport a transfer material, as a transfer belt.

SUMMARY OF THE INVENTION

An object of the present invention is to improve transfer property of an image forming apparatus equipped with a brush-typed transfer member and thereby provide an image forming apparatus with improved transfer property.

Another object of the present invention is to provide an image forming apparatus including an image bearing member adapted to bear a toner image, a transfer belt that is movable, and a transfer device adapted to transfer the toner image from the image bearing member to the transfer belt, the transfer device positioned to opposed to the image bearing member through the transfer belt, the transfer device including a brush member having a plurality of conductive filaments that contacts the belt, wherein conductive filaments located at an upstream end in a moving direction of the transfer belt among the plurality of conductive filaments are cut along a direction perpendicular to the moving direction of the transfer belt.

A further object of the present invention is to provide an image forming apparatus comprising an image bearing member adapted to bear a toner image, a transfer belt that is movable, and a transfer device adapted to transfer the toner image from the image bearing member to the transfer belt, the transfer device positioned to opposed to the image bearing member through the transfer belt, the transfer device including a brush member having a plurality of conductive filaments that contacts the belt, wherein the conductive filaments located at an upstream end in a moving direction of the transfer belt among the plurality of conductive filaments are bonded.

Further features of the present invention will become apparent from the following description of embodiments with reference to the attached drawings.

DESCRIPTION OF THE EMBODIMENTS

Preferred embodiments of the present invention will now be described in detail in accordance with the accompanying drawings.

Embodiments of the present invention will be described in detail below by way of example with reference to the drawings. However, the sizes, materials, shapes, and relative locations of the components described in the embodiments are to be changed as required depending on the configuration and conditions of the apparatus to which the present invention is applied, and the scope of the present invention is not limited to the embodiments described below. Each of the embodiments of the present invention described below can be implemented solely or as a combination of a plurality of the embodiments or features thereof where necessary or where the combination of elements or features from individual embodiments in a single embodiment is beneficial.

First Embodiment

[1. Overall Configuration of Image Forming apparatus]

Figure 1:
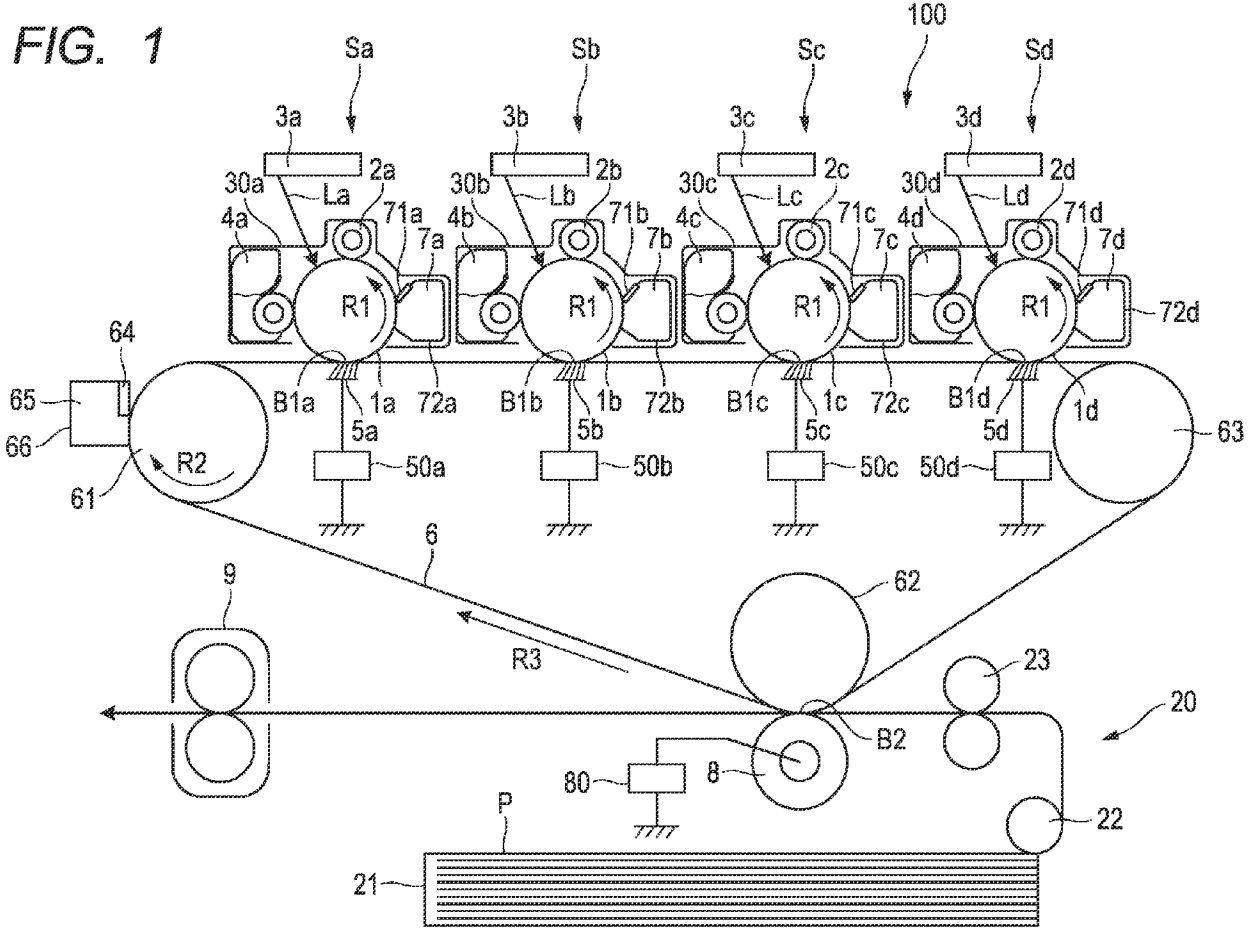
FIG. 1 is a schematic sectional view of an image forming apparatus according to a first embodiment of the present invention.

FIG. 1 is a schematic sectional view showing an overall configuration of an image forming apparatus according to a first embodiment of the present invention. The image forming apparatus 100 in accordance with the first embodiment is an electrophotographic full-color laser beam printer. Also, the image forming apparatus 100 is a tandem type which uses an intermediate transfer method. That is, the image forming apparatus 100 obtains a recorded image by forming toner images of different colors on respective image bearing members based on image information broken down into plural color components, primary-transferring the toner images one after another onto an intermediate transfer member, and secondary-transferring the toner images onto transfer material at once.

The image forming apparatus 100 has first, second, third and fourth stations Sa, Sb, Sc and Sd as a plurality of image forming units. Several components of the stations can be housed in removeable cartridges 30*a*-30*d*. According to the first embodiment, the first to fourth stations Sa to Sd are used to form toner images of different colors of yellow (Y), magenta (M), cyan (C) and black (K), respectively. In terms of configuration and operation, the stations Sa to Sd have much in common. Therefore, when there is no need to makes a distinction among colors, the subscripts a, b, c and d used to indicate the color for which an element is intended will be omitted in the following description.

The image forming apparatus 100 has a photosensitive drum 1 (image bearing member) in each station S. Each photosensitive drum 1 is rotationally driven in the direction of an illustrated arrow R1 (counterclockwise) by a driving unit (not shown). A surface of the photosensitive drum 1 is uniformly charged by a charge roller 2. Next, a laser beam L is emitted to strike the photosensitive drum 1 from an exposure unit 3. The laser beam L is controlled based on the image information, to form an electrostatic latent image. Furthermore, when the surface of the photosensitive drum 1 advances in the direction of the illustrated arrow R1, the latent image formed on the photosensitive drum 1 by a developing device 4 based on the image information is visualized as a toner image. The developing device 4 develops the latent image on the photosensitive drum 1 by a reversal development method. That is, the developing device 4 carries out development by causing toner charged to the same polarity (negative polarity) as the charge polarity (negative polarity) of the photosensitive drum 1 to adhere to an imaging portion (exposure portion) on the uniformly charged photosensitive drum 1 but not the remainder of the drum.

An intermediate transfer belt 6 (belt) serving as an intermediate transfer member is placed downstream of a developing position in a moving direction (rotational direction of the photosensitive drum 1) of the surface of the photosensitive drum 1 indicated by the illustrated arrow R1. The intermediate transfer belt 6 is an endless belt stretched over three rollers: a drive roller 61, secondary transfer counter roller 62 and tension roller 63. The intermediate transfer belt 6 is configured to rotate in the direction of an illustrated arrow R3 (clockwise) substantially at the same speed as a movement speed of the surface of the photosensitive drum 1 when the drive roller 61 is rotationally driven in the direction of an illustrated arrow R2 (clockwise).

A primary transfer brush 5 which is a brush-typed transfer member is placed as a primary transfer device at a position on the opposite side of the intermediate transfer belt 6 from the photosensitive drum 1.

The intermediate transfer belt 6 is placed in contact with the photosensitive drum 1, forming a primary transfer portion B1. As the photosensitive drum 1 and intermediate transfer belt 6 rotate, the toner image formed on the photosensitive drum 1 is primary-transferred to an outer circumferential surface of the intermediate transfer belt 6 by the action of the primary transfer brush 5. In so doing, a primary transfer voltage of a polarity (positive polarity) opposite to the charge polarity (negative polarity) of the toner is applied to the primary transfer brush 5 by a primary transfer power source 50.

Transfer residual toner remaining on the photosensitive drum 1 without being transferred to the intermediate transfer belt 6 in a primary transfer process is cleaned by a photosensitive drum cleaner 7. The photosensitive drum cleaner 7 includes a cleaning blade 71 which is an elastic plate adapted to contact the surface of the photosensitive drum 1. Also, the photosensitive drum cleaner 7 includes a toner container 72 adapted to collect the toner removed from the surface of photosensitive drum 1 by the cleaning blade 71.

The charge, exposure, development and primary transfer processes described above are performed for the colors of yellow, magenta, cyan and black in order starting from the upstream side in the moving direction of the surface of the intermediate transfer belt 6 on the first to fourth stations Sa to Sd. Consequently, a full-color image is formed on the intermediate transfer belt 6 by superimposing toner images of four colors of yellow, magenta, cyan and black.

A secondary transfer roller 8 is placed as a secondary transfer device at a position on the opposite side of the intermediate transfer belt 6 from the secondary transfer counter roller 62. The secondary transfer roller 8 is pressed against the secondary transfer counter roller 62 through the intermediate transfer belt 6, forming a secondary transfer portion B2 (nip portion) in which the intermediate transfer belt 6 and secondary transfer roller 8 contact each other. The toner images on the intermediate transfer belt 6 are secondary-transferred onto transfer material P by the action of secondary transfer roller 8. That is, the transfer material P contained in a cassette 21 in a transfer material supply portion 20 is sent out by a feed roller 22, and then supplied with predetermined timing by a resist roller 23 to the secondary transfer portion B2, in which the intermediate transfer belt 6 and secondary transfer roller 8 contact each other. Almost simultaneously, a secondary transfer voltage of a polarity (positive polarity) opposite to regular charge polarity of the toners is applied to the secondary transfer roller 8 from a secondary transfer power source 80. The toner images are transferred to the transfer material P from the intermediate transfer belt 6 while the transfer material P is being transported in a pinched state through the secondary transfer portion B2, and then the transfer material P is transported to a heat fixing device 9. When heated under pressure by the heat fixing device 9, the toner images are fixed to the transfer material P.

A cleaning blade 64 is placed at a position on the opposite side of the intermediate transfer belt 6 from the drive roller 61. The cleaning blade 64 comes into contact with the intermediate transfer belt 6 and collects transfer residual toner remaining on the intermediate transfer belt 6 without being transferred to the transfer material P in the secondary transfer process.

The image forming apparatus according to the first embodiment is a printer which offers a processing speed of 116 mm/s and supports A4-size paper.

[2. Configuration of Primary Transfer Brush 5]

Figure 2:
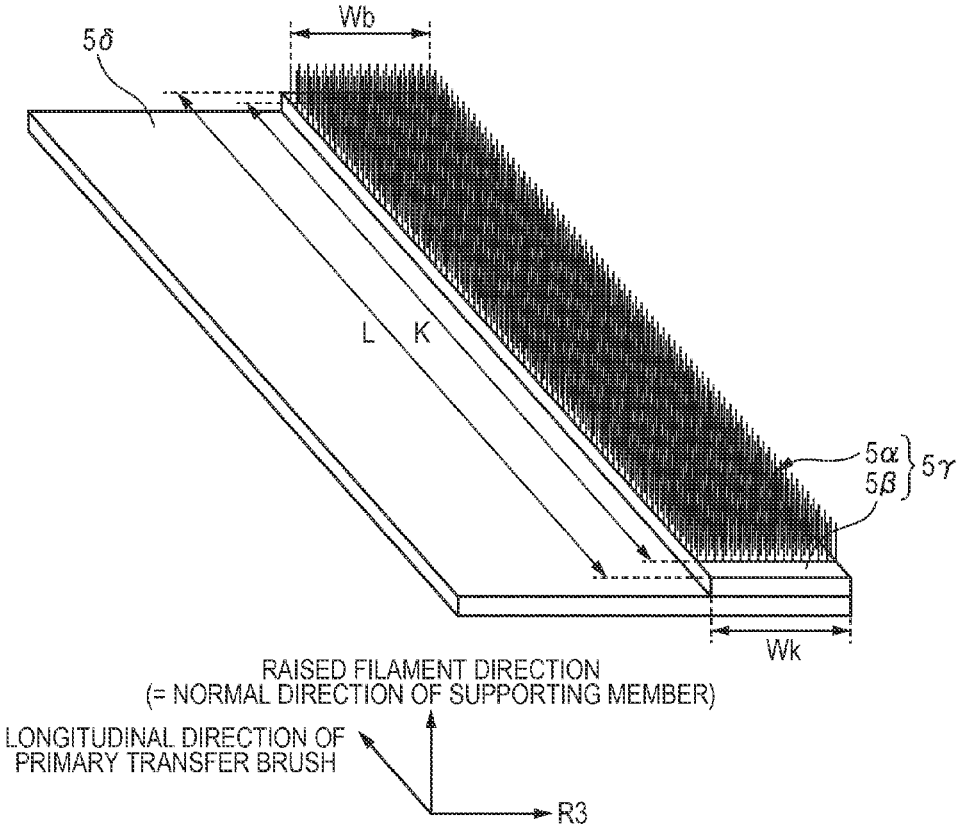
FIG. 2 is a perspective view of a primary transfer brush according to the first embodiment of the present invention.

FIG. 2 is a schematic diagram (perspective view) of the primary transfer brush 5 according to the first embodiment. The primary transfer brush 5 is configured by bonding together a brush member 5γ and a resin seat 5δ (supporting member) (e.g., made of polyester) by a conductive adhesive (not shown). One end of the seat 5δ is fixed to a fixing member 70 (illustrated in FIG. 5) and another end is a free end. The brush member 5γ includes a raised filament portion 5α made up of plural conductive filaments 5δ and a base fabric portion 5β made up of non-conductive filaments. The base fabric portion 5β is a holding portion adapted to hold the plural conductive filament. The conductive filaments 5ϵ are raised in a direction perpendicular (direction of a normal) to the resin sheet 5δ. A pile fabric in which the conductive filaments 5ϵ serving as the raised filament portion 5α are arranged densely is used as the brush member 5γ.

A shorter dimension Wb (in a direction set parallel to the moving (rotational) direction of the intermediate transfer belt) of the raised filament portion 5α of the primary transfer brush 5 is Wb=7 mm. Also, a shorter dimension Wk of the base fabric portion 5β of the primary transfer brush 5 is Wk=7 mm (the same size as the raised filament portion 5α). A longer dimension L (in a direction set perpendicular to the moving (rotational) direction of the intermediate transfer belt 6) of the primary transfer brush 5 is L=250 mm. Of this dimension, the raised filament portion 5α is provided in a region of k=230 mm, and a 10-mm region not covered by the raised filament portion 5α is provided equally at both ends in the longitudinal direction. The dimension of Wb=7 mm allows a sufficiently wide nip to be formed between the primary transfer brush 5 and the intermediate transfer belt 6 and the dimension of K=230 mm allows a sufficient width for image formation even when A4 paper is used.

Figure 3A:
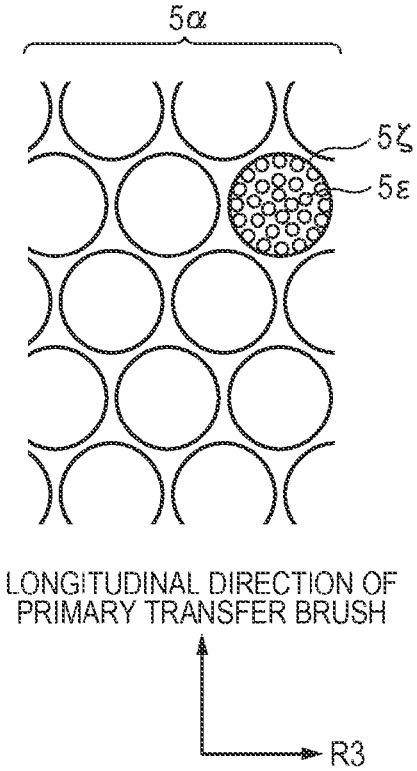
FIGS. 3A and 3B are top views of a raised filament portion of the primary transfer brush according to the first embodiment of the present invention.
Figure 3B:
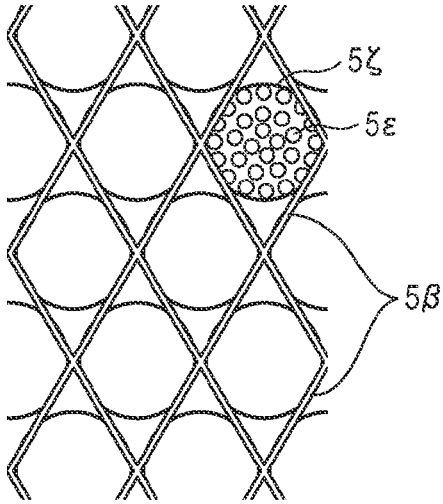

FIG. 3A is a schematic diagram (top view) of the raised filament portion 5α of the primary transfer brush 5 according to the first embodiment. In the raised filament portion 5α, filament bundles 5ξ configured by intertwisting plural conductive filaments 5ϵ are arrayed at fixed intervals so as to achieve a density of 5000 to 50000 bundles/cm$^2$. Each filament bundle 5ξ has a diameter of 200 to 700 μm while a center distance between two adjacent filament bundles 5ξ is 400 to 1400 μm. When the plural filament bundles of the brush member 5γ are projected so as to line up in the moving direction of the intermediate transfer belt 6, the filament bundles 5ξ are arranged in a staggered manner such that at least any of the filament bundles 5ξ will exist in a longitudinal region contributing to the primary transfer of the primary transfer brush 5. FIG. 3B is a schematic diagram (top view) describing lengthwise strings and crosswise strings of the base fabric portion 5β. When implemented in the form of a pile fabric, the base fabric portion 5β is configured such that meshes are formed by the lengthwise strings and crosswise strings with the filament bundles 5ξ being arrayed between the lengthwise strings and crosswise strings, as shown in FIG. 3B. In this way, the filament bundles 5ξ can be arrayed in a desired pattern using the base fabric portion 5β.

Thus, the present embodiment uses an arrangement in which overlapping regions are formed between adjacent filament bundles 5ξ, i.e., no gap is formed between the adjacent filament bundles 5ξ when the raised filament portion 5α is viewed in the moving direction of the intermediate transfer belt 6. This provides good primary transfer images by reducing image defects of vertical streaks caused by uneven contact between the intermediate transfer belt 6 and the primary transfer brush 5.

In the first embodiment, conductive nylon filaments scattered with carbon powder are used as the conductive filaments 5ϵ of the raised filament portion 5α. Suitably, the filaments have a monofilament fineness in the range of 2 to 15 dtex (where dtex represents mass (in grams) per 10,000 meters of monofilament), a diameter in the range of 10 to 40 μm, and a dry strength in the range of 1 to 3 cN/dtex. Suitably, the resistivity pfiber of the filament is in the range of 10 to $10^8$ Ω cm.

The resistivity ρfiber is measured as follows. Specifically, 50 filaments are gathered into a bundle and a metal probe is brought into contact with a surface of the bundle at intervals of approximately 1 cm. Resistance Rfiber is actually measured at an applied voltage of 100 V using a high resistance meter such as Advantest R8340A, and the resistivity ρfiber is calculated using the following equation.

$$\rho\text{fiber}=\text{Rfiber}\times(\text{filament diameter}/2)^2\times3.14\times50\div1.0$$

On the primary transfer brush 5 in a non-contact state (state in which no pressure is applied to the filaments), a direction in which the conductive filaments 5ϵ extend from a plane of the base fabric portion 5β is referred to as a raised filament direction. Filament length of each filament measured from the base fabric portion 5β is 1 to 5 mm. The filament length is smaller than a shorter dimension Wb of the raised filament portion 5α of the primary transfer brush 5. The reduced filament length allows the filaments to come into contact with the intermediate transfer belt stably even if the filaments lie down by coming into contact with the rotating and moving intermediate transfer belt 6.

Filament material used for the raised filament portion 5α is not limited to nylon filaments, and any filament material may be used as long as the filament material is made conductive. Also, although non-conductive polyester filaments are used for the base fabric portion 5β in the first embodiment, this is not restrictive, and any filaments may be used as long as the raised filament portion 5α can be woven.

Typical characteristics of the brush member 5γ used in the first embodiment are specified as follows.

<Specifications For Primary Transfer Brush>

Item type: pile fabric

Material: nylon filaments scattered with carbon powder

Monofilament fineness: 7 dtex

Filament diameter: 28 μm

Dry strength: 1.6 cN/dtex

Resistivity: $10^6$Ω cm

Filament length: 2 mm

Array density: 10850 bundles/$cm^2$

The primary transfer brush 5 is placed at a position opposed to the photosensitive drum 1 through the intermediate transfer belt 6, contacting the back surface of the intermediate transfer belt 6. Note that the diameter of the photosensitive drum 1 is 30 mm. Also, a primary transfer voltage of 0 to 1.0 kV can be applied to the primary transfer brush 5 from the primary transfer power source 50. A contact configuration of the primary transfer brush 5 will be described later.

[3. Intermediate Transfer Belt]

A 60-μm thick belt made of polyimide resin can be used as the intermediate transfer belt 6 with volume resistivity of the polyimide resin having been adjusted to be $10^9$Ω cm by mixing a conductive agent. Also, the intermediate transfer belt 6 is stretched by three shafts of the drive roller 61, secondary transfer counter roller 62 and tension roller 63, and a total pressure of 20 N is exerted as tension by the tension roller 63.

Also, an intermediate transfer belt cleaner 65 is provided on the front surface of the intermediate transfer belt 6, where the intermediate transfer belt cleaner 65 includes a cleaning blade 64, which is an elastic plate, and serves as a cleaning member adapted to remove toner adhering to the intermediate transfer belt 6. The toner removed from the front surface of the intermediate transfer belt by the cleaning blade 64 is collected in a toner container 66.

[4. Secondary Transfer Roller]

An elastic roller with a volume resistivity of $10^7$ to $10^9$Ω cm and a hardness of 30° to 40° can be used as the secondary transfer roller 8. The secondary transfer roller 8 is pressed against the secondary transfer counter roller 62 through the intermediate transfer belt 6 at a total pressure of about 39.2 N. Also, the secondary transfer roller 8 rotates, following rotation of the intermediate transfer belt 6. Furthermore, a secondary transfer voltage of 0 to 4.0 kV can be applied to the secondary transfer roller 8 from a secondary transfer power source 80.

[5. Upstream End Geometry of Primary Transfer Brush 5]

Figure 4:
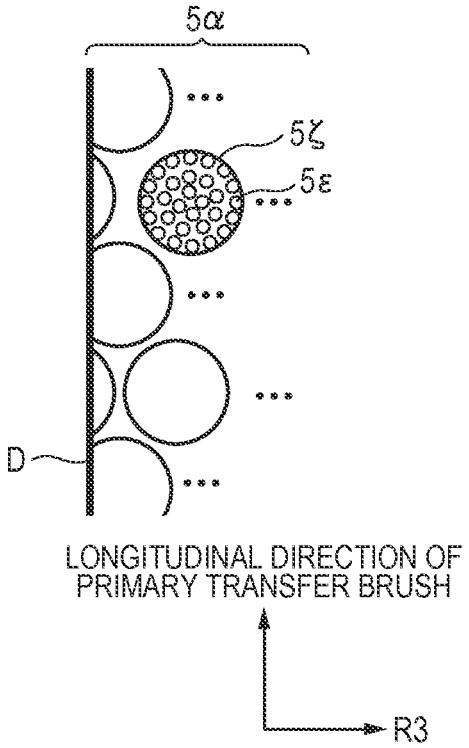
FIG. 4 is a top view of an upstream end of the primary transfer brush according to the first embodiment of the present invention.

FIG. 4 is a schematic diagram (top view) of an upstream end of the brush member 5γ in the moving direction of the intermediate transfer belt according to the first embodiment. An upstream end geometry of the primary transfer brush 5, which is characteristic of the first embodiment, will be described. The primary transfer brush 5 used in the first embodiment is characterized in that the raised filament portion 5α and base fabric portion 5β are cut such that the upstream end geometry of the primary transfer brush 5 will be substantially rectilinear along the length of the primary transfer brush 5 (in a direction orthogonal to the moving direction of the intermediate transfer belt). It can be seen that the upstream end D of the primary transfer brush 5 runs substantially rectilinearly along a locus cutting through the plural filament bundles 5ξ.

More specifically, of the plural filament bundles 5ξ, a filament bundle 5ξ located on the most upstream side of each column in the rotational direction of the intermediate transfer belt 6 has, on the upstream side of the rotational direction, an end face which substantially coincides with a same imaginary plane substantially orthogonal to the rotational direction. The filament bundle 5ξ located on the most upstream side is cut along a same cutting plane substantially orthogonal to the rotational direction of the intermediate transfer belt 6 so as to form the end face. The filament bundle 5ξ located on the most upstream side is configured such that, of the plural filaments 5ϵ making up the filament bundle 5ξ, holding positions of the filaments 5ϵ located on the most upstream side in the rotational direction of the intermediate transfer belt 6 are arranged in a direction substantially orthogonal to the rotational direction. Also, the holding positions are aligned on substantially the same line as the holding positions of the most upstream filaments 5ϵ in the rotational direction in the most upstream filament bundles 5ξ of adjacent columns.

[6. Contact Configuration And Nip Arrangement of Primary Transfer Brush 5]

Figure 5:
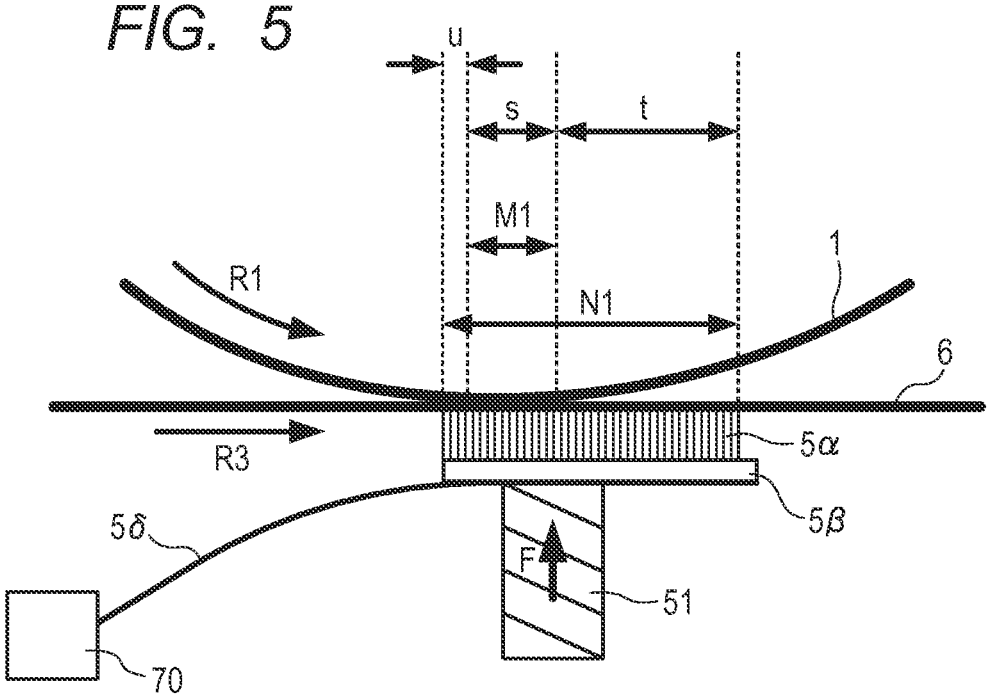
FIG. 5 is an explanatory diagram of a contact configuration and nip arrangement of the primary transfer brush according to the first embodiment of the present invention.

FIG. 5 is a schematic diagram describing a contact configuration and nip arrangement of the primary transfer brush 5 according to the first embodiment. The contact configuration and nip arrangement are common to the primary transfer portions of all the stations Sa to Sd, so one station will be taken as an example. The brush member 5γ according to the first embodiment is held by a supporting member (not shown) and caused to contact the back surface of the intermediate transfer belt 6 by a pressing force F of a spring 51 (urging member). The total pressing force is F=4.9 N and a direction of F is substantially parallel to the direction of a normal to the front surface of the intermediate transfer belt 6.

In FIG. 5, a nip M1 is formed between the photosensitive drum 1 and intermediate transfer belt 6. The intermediate transfer belt 6 stretched rectilinearly by the drive roller 61 and tension roller 63 is placed so as to form a 1-mm wide nip in conjunction with the photosensitive drum at each station.

On the other hand, a nip N1 is formed between the intermediate transfer belt 6 and primary transfer brush 5. In a separated state (state in which no pressure is applied to the filaments), the raised filament portion 5α of the primary transfer brush 5 is raised perpendicularly to a seat 5δ of the primary transfer brush 5. However, when brought into contact with the back surface of the intermediate transfer belt 6 by the pressing force F, the raised filament portion 5α lies down to some extent. In this state, a restoring force tending to return to a raised posture perpendicular to the seat 5δ acts on the raised filament portion 5α, exerting a force (reaction force) pushing back the primary transfer brush 5 away from the intermediate transfer belt 6. Therefore, the primary transfer brush 5 stabilizes after being pressed against the back surface of the intermediate transfer belt 6 to such an extent that the pressing force F and reaction force are balanced. FIG. 5 shows a state in which the two forces are in balance. The nip N1 between the belt and brush is 7.0 mm wide.

Next, s, t and u in FIG. 5 will be described. Arrangement of s, t and u in relation to one another is important to obtain good primary transfer property in the image forming apparatus according to the first embodiment.

An overlap nip (s) is a region in which the photosensitive drum 1, intermediate transfer belt 6 and primary transfer brush 5 are placed in contact with one another, forming a transfer electric field. If the region is not formed, good primary transfer efficiency is not available. In the first embodiment, the overlap nip (s) is 2.0 mm.

A tension nip (t) is a region which is located downstream of the overlap nip (s) and in which only the intermediate transfer belt 6 and primary transfer brush 5 come into contact with each other. This region is intended for a surplus transfer charge remaining on the belt to flow back to the primary transfer brush 5 and needed in order to prevent the images from being affected by abnormal electrical discharges. In the first embodiment, the tension nip (t) is 4.5 mm.

A spare nip (u) is a region where the nip (N1) between the intermediate transfer belt 6 and primary transfer brush 5 juts out toward the upstream side from the nip (M1) between the photosensitive drum 1 and the intermediate transfer belt 6. If this region increases, a vacant nip is formed upstream of the primary transfer portion with a transfer electric field formed therein, resulting in transfer scatter during pre-transfer. In the first embodiment, the spare nip (u) is 0.5 mm.

To obtain good primary transfer property, it is necessary to form both overlap nip (s) and tension nip (t). It is also necessary that the spare nip (u) it not large. In the contact configuration according to the first embodiment, components are placed so as to secure regions of 2.0 mm and 4.5 mm, respectively, for the overlap nip (s) and tension nip (t) and so as to limit the spare nip (u) desirably to 0.5 mm. Thus, good primary transfer property is obtained. Incidentally, detailed studies were conducted using this configuration and it was confirmed that good primary transfer property was obtained when widths of 1.5 mm or above, 3.5 mm or above, and 1.2 mm or below were secured, respectively, for the overlap nip (s), tension nip (t) and spare nip (u).

According to the present embodiment, the seat 5δ adapted to support the brush member 5γ is fixed by a fixing member 70 on the upstream side in the moving direction of the belt, but a configuration in which no fixing member 70 is used may be used alternatively. Also, a metal plate or resin plate may be used as the supporting member instead of the seat 5δ.

Figure 15:
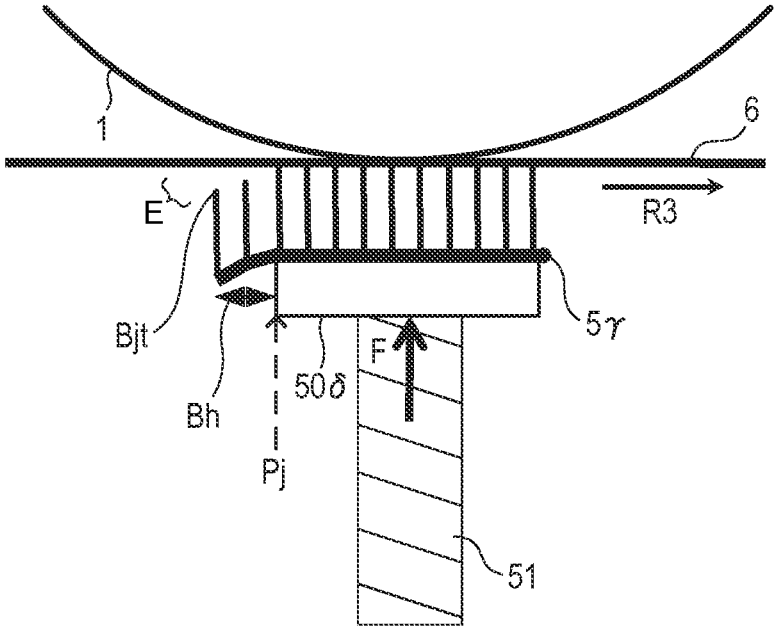
Prior Art FIG. 15
FIG. 15 is an explanatory diagram for describing a non-contact area E.

In such a case, it is necessary to ensure that the upstream end of the brush member 5γ will come into contact with the intermediate transfer belt 6. Now, as a comparative example, a supporting member shown in FIG. 15 will be described. The supporting member shown in FIG. 15 is a metal plate 50δ, and an upstream end Pj of the metal plate 50δ is located downstream of an upstream end Bjt of the brush member 5γ. In FIG. 15, Bh represents a distance between the upstream end Bjt of the brush member 5γ and the upstream end Pj of the metal plate 50δ.

In this configuration, as shown in the sectional view of the primary transfer portion in FIG. 15, there can be a noncontact area E on the upstream side. An amount of noncontact in the noncontact area E varies because a distance between the intermediate transfer belt 6 and primary transfer brush 5 cannot be controlled in the noncontact area E. In such case, the transfer electric field produced by a primary transfer bias formed by changes in the amount of noncontact (distance of noncontact between the intermediate transfer belt 6 and brush member 5γ) in the noncontact area E will become nonuniform in the longitudinal direction. The nonuniformity of the transfer electric field appears as irregularities of a potential (a few tens of volts) on the intermediate transfer belt 6, consequently disturbing the toner images on the photosensitive drums and resulting in an image defect (so-called scatter) which involves image blur or in density unevenness.

Thus, according to the present embodiment, as shown in FIG. 5, an upstream end of the seat 5δ, which is a supporting member, is placed upstream of the upstream end of the brush member 5γ along the moving direction of the intermediate transfer belt 6, thereby reducing the noncontact area E.

[7. Impacts of Component Mounting Locations]

With the image forming apparatus according to the first embodiment, when impacts of variations in the locations of components are considered, a mounting location of the primary transfer brush 5 fluctuates within a range of about ±0.5 mm in the moving direction of the intermediate transfer belt 6. However, it was confirmed that even if there was a variation in the mounting location of the primary transfer brush 5, the first embodiment always provided good primary transfer property. This is because the upstream end geometry of the primary transfer brush 5 used in the first embodiment is substantially rectilinear along the length of the primary transfer brush 5. This configuration allows the spare nip (u) to be set to 1.0 mm at the maximum, which is smaller than the above-mentioned value of 1.2 mm. It can be said that this is a characteristic effect of the first embodiment.

Now, features of the first embodiment will be described in comparison with comparative configuration 1.

<Comparative Configuration 1>

Figure 6:
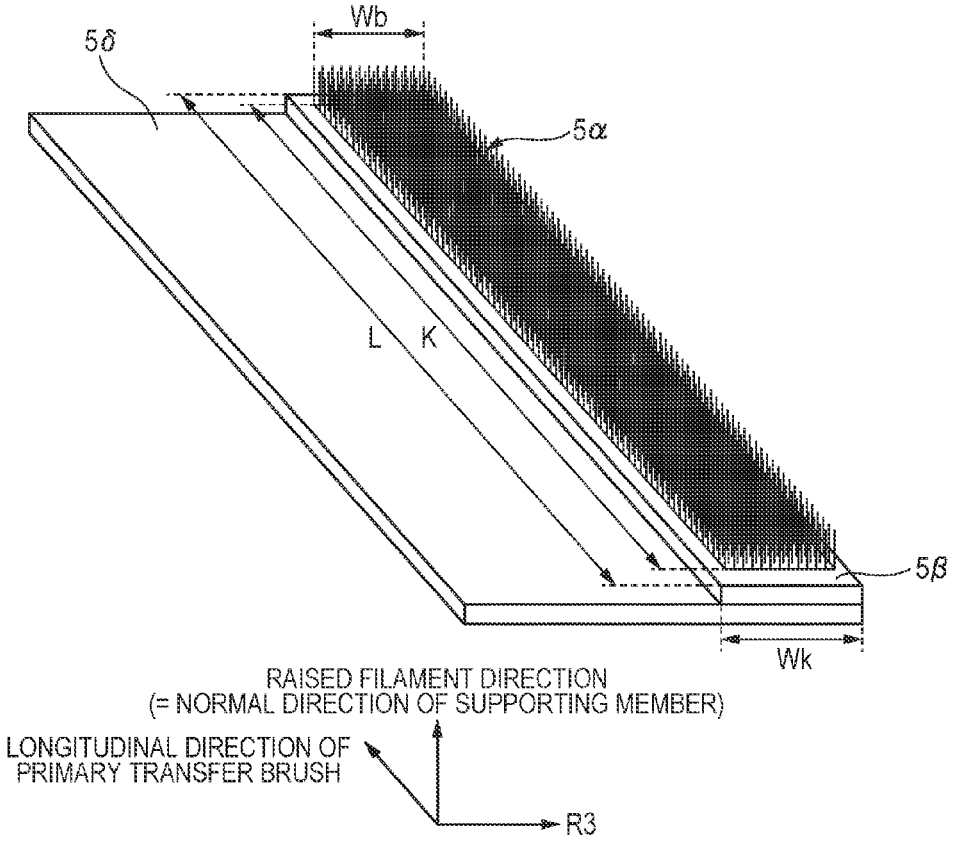
Prior Art FIG. 6
FIG. 6 is a perspective view of a primary transfer brush according to comparative configuration 1.

FIG. 6 is a schematic diagram (perspective view) of a primary transfer brush 5 in comparative configuration 1. The primary transfer brush 5 used in comparative configuration 1 differs from that of the first embodiment in that the raised filament portion 5α and base fabric portion 5β are not cut. The shorter dimension (in a direction set parallel to the moving (rotational) direction of the intermediate transfer belt) of the raised filament portion 5α of the primary transfer brush 5 is Wb=7 mm. Also, the shorter dimension Wk of the base fabric portion 5β of the primary transfer brush 5 is Wk=8 mm. Other dimensions as well as the configuration of the image forming apparatus used are similar to those of the first embodiment, and thus description thereof will be omitted.

Figure 7:
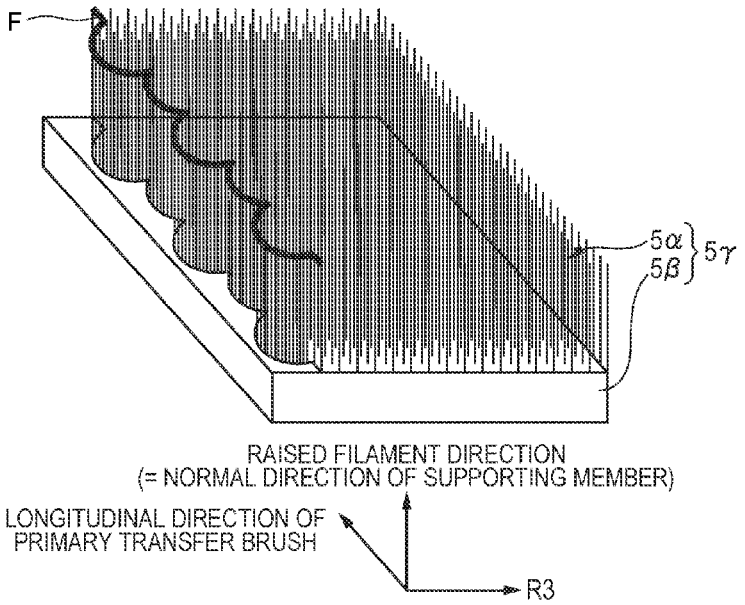
Prior Art FIG. 7
FIG. 7 is an enlarged perspective view of an upstream end of the primary transfer brush according to comparative configuration 1.

FIG. 7 is an enlarged schematic diagram (perspective view) of an upstream end of the primary transfer brush 5 in comparative configuration 1. As described with reference to FIGS. 3A and 3B, in the raised filament portion 5α of the primary transfer brush 5 used in the first embodiment and comparative configuration 1, plural filament bundles 5ξ are arrayed in a staggered manner in the longitudinal direction of the primary transfer brush 5. Consequently, as shown in FIG. 7, the upstream end of the raised filament portion 5α of the primary transfer brush 5 draws a locus F along which smooth concavities and convexities alternate repeatedly.

Figure 8:
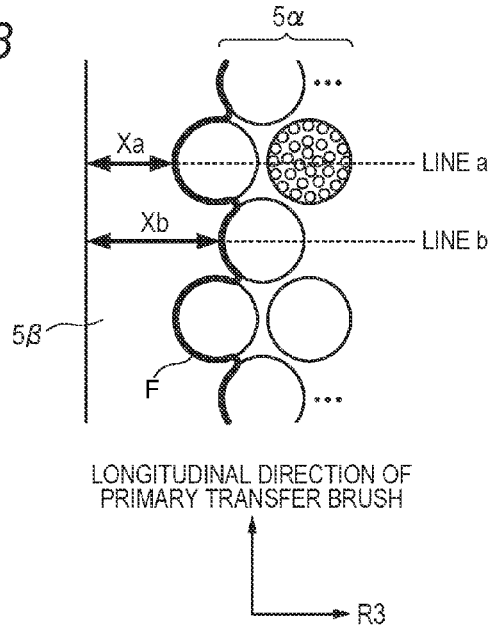
Prior Art FIG. 8
FIG. 8 is an enlarged top view of the upstream end of the primary transfer brush according to comparative configuration 1.

FIG. 8 is an enlarged schematic diagram (top view) of the upstream end of the primary transfer brush 5 in comparative configuration 1. Depending on the array of raised filament bundles described above, a distance from an upstream end of the base fabric portion 5β to the upstream end of the raised filament portion 5α took a minimum value Xa (on line a) of Xa=500 μm in some part, and a maximum value Xb (line b) of Xb=800 μm in other part.

Figure 9A:
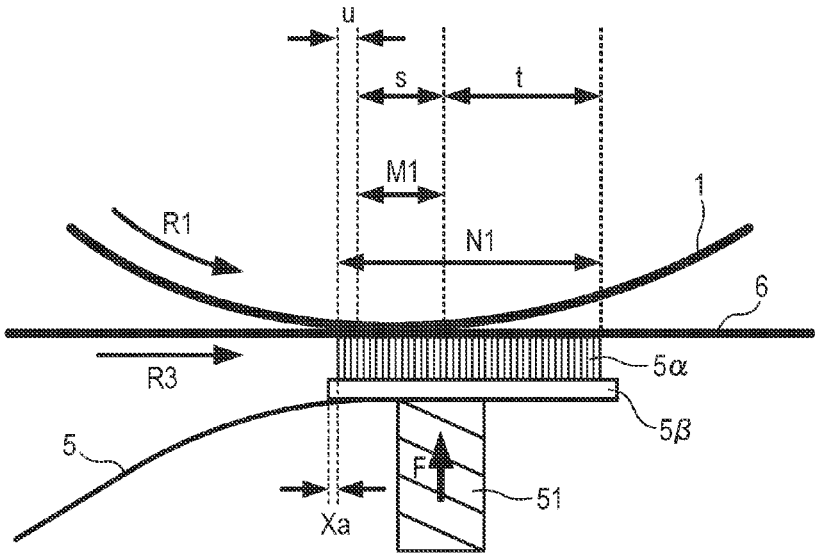
Prior Art FIG. 9A
FIGS. 9A and 9B are explanatory diagrams of contact configurations and nip arrangements of the primary transfer brush according to comparative configuration 1.
Figure 9B:
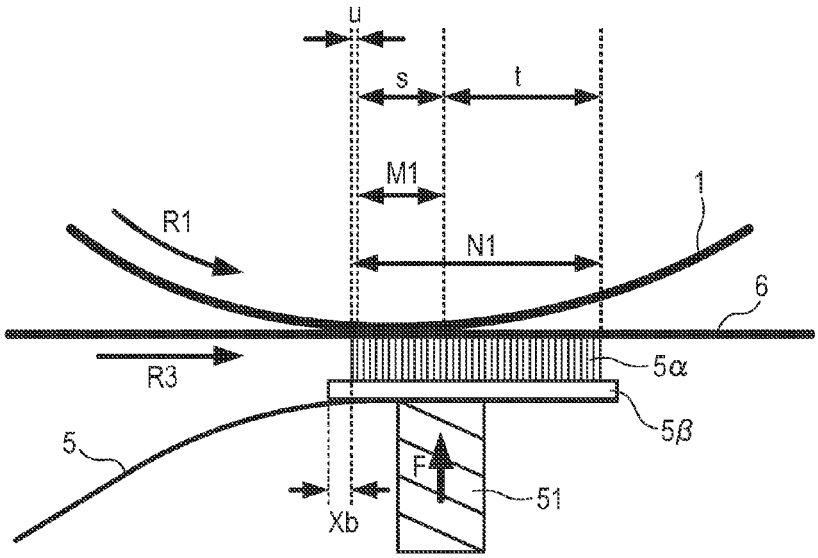
Prior Art FIG. 9B

FIGS. 9A and 9B are schematic diagrams describing nip arrangements of the primary transfer brush 5 according to comparative configuration 1, where FIG. 9A shows a nip arrangement on the line a and FIG. 9B shows a nip arrangement on the line b. In FIG. 9A, regions of 2.0 mm and 4.5 mm are secured, respectively, for the overlap nip (s) and tension nip (t) as with the first embodiment. On the other hand, the spare nip (u) is 0.2 mm, which is shorter than 0.5 mm of the first embodiment, but since this satisfies the condition of 1.2 mm or below, which is required of the spare nip (u), it is expected that good primary transfer property is available. Also, even when the above-described fact that the mounting location of the primary transfer brush 5 changes within the range of about ±0.5 mm in the moving direction of the intermediate transfer belt 6 is taken into consideration, the spare nip (u) will be 0.7 mm at the maximum. Thus, it is expected that good primary transfer property is always available.

In FIG. 9B, regions of 2.0 mm and 4.5 mm are secured, respectively, for the overlap nip (s) and tension nip (t) as with the first embodiment. On the other hand, the spare nip (u) is 0.8 mm, which is longer than 0.5 mm of the first embodiment, but since this satisfies the condition of 1.2 mm or below, which is required of the spare nip (u), it is expected that good primary transfer property is available. However, when the fact that the mounting location of the primary transfer brush 5 changes within the range of about ±0.5 mm in the moving direction of the intermediate transfer belt 6 is taken into consideration, the spare nip (u) will reach up to 1.3 mm, so it is expected that transfer scatter will occur during pre-transfer. Thus, in comparative configuration 1, images were checked by actually changing the primary transfer brush 5 within the range of about ±0.5 mm in the moving direction of the intermediate transfer belt 6, it was confirmed that sometimes image defects in the form of vertical streaks occurred, failing to provide good primary transfer property.

For the reasons described above, even if there are variations in component mounting locations of the image forming apparatus, the first embodiment can secure good primary transfer property by absorbing dimensional errors and mounting errors using the primary transfer brush 5 whose upstream end geometry is substantially rectilinear.

Figure 14:
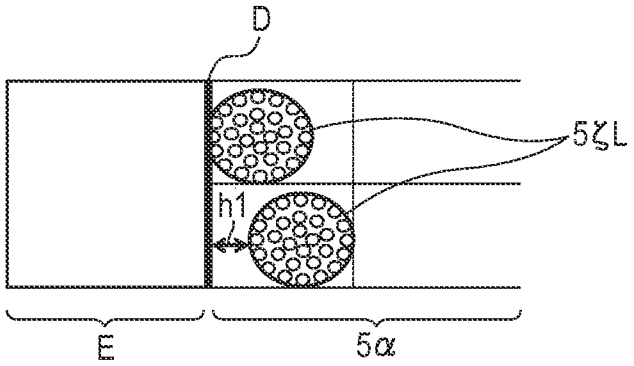
FIG. 14 is an enlarged view of filament bundles at an upstream end of the primary transfer brush according to the first embodiment of the present invention.

Also, the upstream end D according to this first embodiment is substantially rectilinear, and specifically, good primary transfer property can be secured if the filaments placed on the most upstream side in a direction substantially orthogonal to the rotational direction of the intermediate transfer belt 6 fall within 0.5 mm from the upstream end D. As shown in FIG. 14, when viewed microscopically, there are variations in filament bundles 5ξL, which are filament bundles placed on the most upstream side. Thus, as shown in FIG. 14, some of the filaments placed on the most upstream side are sometimes located downstream of the upstream end D. Even in such a case, if the filaments fall within a distance (h1 in FIG. 14) of 0.6 mm from the upstream end D, it can be said that the filaments are located substantially on a straight line. Note that in FIG. 14, part E is removed by cutting.

Second Embodiment

Figure 10:
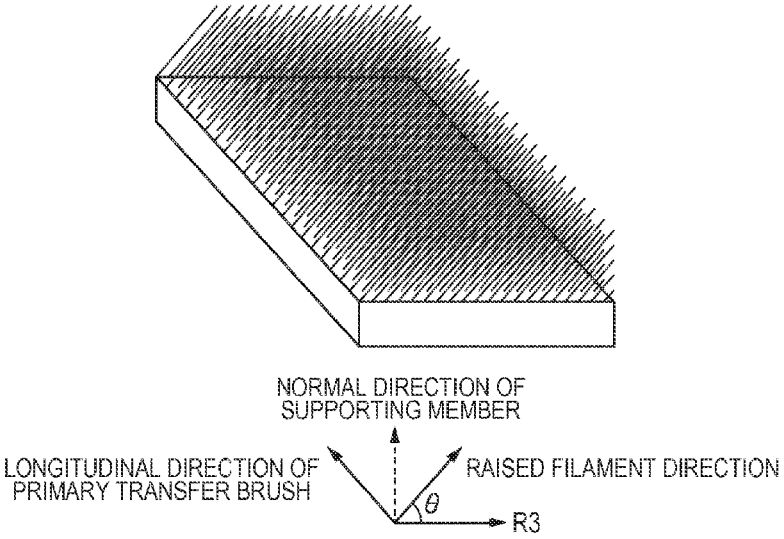
FIG. 10 is an enlarged perspective view of an upstream end of the primary transfer brush according to a second embodiment of the present invention.
Figure 11:
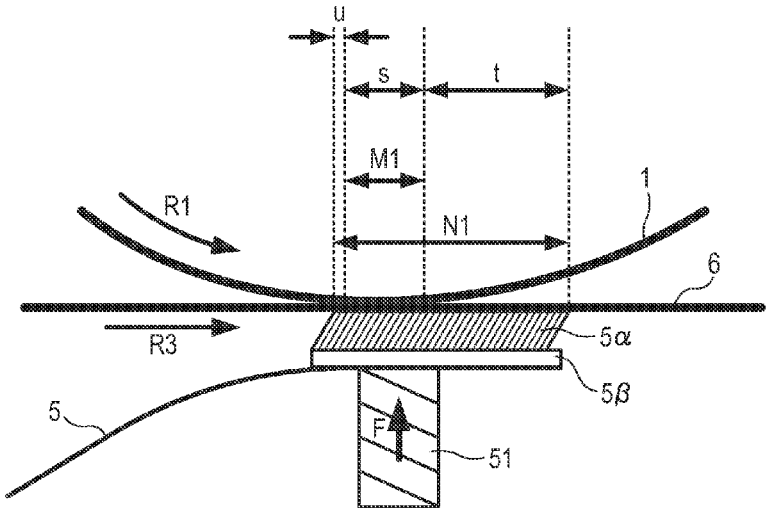
FIG. 11 is an explanatory diagram of a contact configuration and nip arrangement of the primary transfer brush according to the second embodiment of the present invention.

An image forming apparatus according to a second embodiment of the present invention will be described with reference to FIGS. 10 and 11. An upstream end geometry of the primary transfer brush 5 characteristic of the second embodiment will mainly be described here. Matters not described here particularly are matters similar to those of the first embodiment. The same components as those in the first embodiment are denoted by the same reference numerals as the corresponding components in the first embodiment, and description thereof will be omitted.

The primary transfer brush 5 used in the second embodiment is characterized in that the filaments in the raised filament portion 5α have been tilted in the moving direction of the intermediate transfer belt 6 and that the raised filament portion 5α and base fabric portion 5β have been cut such that the upstream end geometry of the primary transfer brush 5 will be rectilinear along the length of the primary transfer brush 5. This provides better primary transfer property than the first embodiment. FIG. 10 is an enlarged schematic diagram (perspective view) of the upstream end of the primary transfer brush 5 according to the second embodiment. It can be seen that the upstream end D of the primary transfer brush 5 runs substantially rectilinearly along the locus of cutting.

A contact configuration and nip arrangement of the primary transfer brush 5 according to the second embodiment will be described with reference to FIG. 11. The image forming apparatus according to the second embodiment is similar in configuration to the image forming apparatus according to the first embodiment (FIG. 1) as a whole, and thus detailed description thereof will be omitted. In the contact configuration of the second embodiment, components are placed so as to secure regions of 2.0 mm and 4.5 mm, respectively, for the overlap nip (s) and tension nip (t) and so as to limit the spare nip (u) desirably to 0.5 mm, as with the first embodiment.

Images were checked by actually using the image forming apparatus and it was confirmed that better primary transfer property than that in the first embodiment was available. This is because in a separated state (state in which no pressure is applied to the filaments), the raised filament portion 5α of the primary transfer brush 5 is raised, maintaining a tilt angle θ(θ<90°) to the seat 5δ of the primary transfer brush 5. That is, when caused to contact the back surface of the intermediate transfer belt 6 by a pressing force F, the raised filament portion 5α lies down in excess of the tilt angle θ. Consequently, tips of the conductive filaments 5ε of the raised filament portion 5α contact the back surface of the intermediate transfer belt 6 by coming into contact nearly parallel to the back surface of the intermediate transfer belt 6 both on the upstream and downstream sides. This increases an area of contact with the back surface of the intermediate transfer belt 6 and thereby provides a more uniform distribution. Thus, regarding formation of a transfer electric field between the back surface of the intermediate transfer belt 6 and the raised filament portion 5α, the transfer electric field has a more uniform distribution in the nip (N1) between the intermediate transfer belt 6 and primary transfer brush 5 than in the case of the first embodiment and comparative configuration 1.

Thus, the second embodiment not only reduces random inclination of the conductive filaments 5ε in the raised filament portion 5α of the primary transfer brush 5, but also further improves the uniformity of contact with the back surface of the intermediate transfer belt 6 compared to the first embodiment, where the uniformity of contact is characteristic of the primary transfer brush 5. This more properly reduces image defects such as density unevenness occurring in the primary transfer process.

Third Embodiment

An image forming apparatus according to a third embodiment of the present invention will be described with reference to FIGS. 12 and 13. An upstream end geometry of the primary transfer brush 5 characteristic of the third embodiment will mainly be described here. Matters not described here particularly are matters similar to those of the embodiments described above. The same components as those in the above embodiments are denoted by the same reference numerals as the corresponding components in the above embodiments, and description thereof will be omitted.

Figure 12:
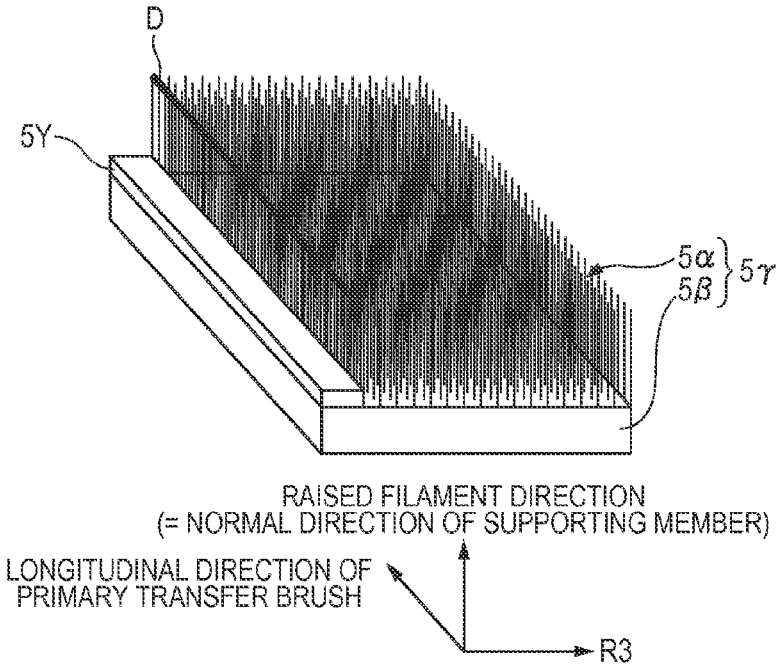
FIG. 12 is an enlarged perspective view of an upstream end of a primary transfer brush according to a third embodiment of the present invention.
Figure 13:
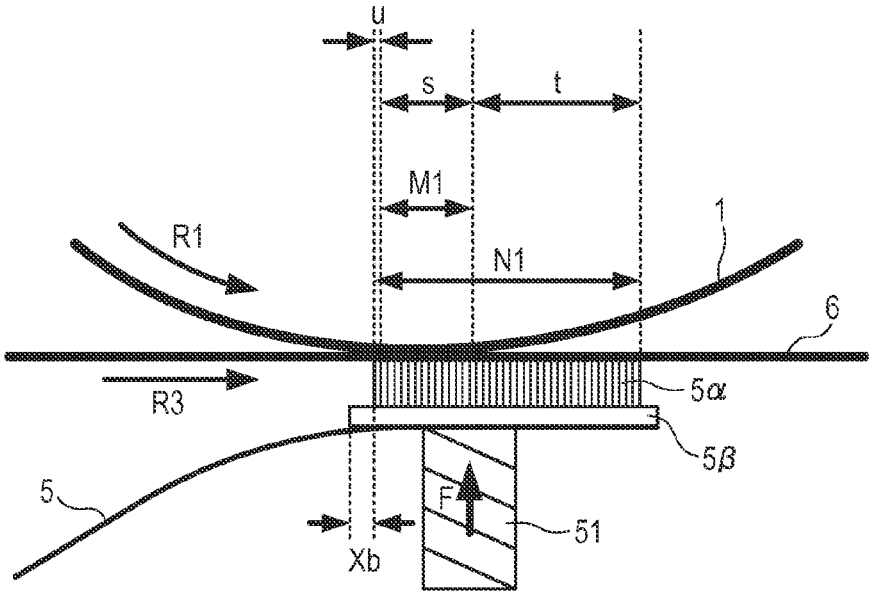
FIG. 13 is an explanatory diagram of a contact configuration and nip arrangement of the primary transfer brush according to the third embodiment of the present invention.

FIG. 12 is an enlarged schematic diagram (perspective view) of the upstream end of the primary transfer brush 5 according to the third embodiment.

The raised filament portion 5α is bonded together such that the upstream end geometry of the primary transfer brush 5 used in the third embodiment will be substantially rectilinear along the length of the primary transfer brush 5. More particularly, in the third embodiment, each of the most upstream filament bundles 5ξ in the rotational direction of the intermediate transfer belt 6 is partially fused together by a welding process so as to form an upstream-side end face similar to that of the first embodiment (see FIG. 4). Also, adjacent filament bundles are fusion-bonded together by a welding process. A conceivable method of the welding process involves, for example, perpendicularly pressing the raised filament portion 5α of the brush member 5γ towards the base fabric portion 5β from above by a welding unit. With this method, the raised filament portion 5α melted by heat is bonded directly to the base fabric portion 5β. The portion bonded to the base fabric portion 5β is formed as a weld 5γ on the base fabric portion 5β as shown in FIG. 12.

This provides better primary transfer property than the first and second embodiments throughout the lifetime of the image forming apparatus. It can be seen that the upstream end D of the primary transfer brush 5 runs substantially rectilinearly along the portion 5γ in which the conductive filaments 5ε are fusion-bonded together.

Possible methods for welding the raised filament portion 5α of the primary transfer brush 5 include a method which involves heating a blade member or roll member made, for example, of metal at least to a temperature capable of welding the conductive filaments 5ε and then carrying out welding by pressing the conductive filaments 5ε and raised filament portion 5α in contact with each other. Also, there is a method which performs welding by pressing the conductive filaments 5ε and raised filament portion 5α in contact with each other using high-frequency oscillation of the blade member or roll member. Note that any method may be used as long as the raised filament portion 5α can be fusion-bonded substantially rectilinearly.

Also, the filament bundles 5ξ located on the most downstream side in the moving direction of the intermediate transfer belt 6 may be fusion-bonded as in the case of the upstream side. On the downstream side, filaments are partially fused together by a welding process so as to form a downstream-side end face similar to the end face on the upstream side.

A contact configuration and nip arrangement of the primary transfer brush 5 according to the third embodiment will be described with reference to FIG. 13. The image forming apparatus according to the third embodiment is similar in configuration to the image forming apparatus according to the first and second embodiments (FIG. 1) as a whole, and thus detailed description thereof will be omitted. In the contact configuration of the third embodiment, components are placed so as to secure regions of 2.0 mm and 4.5 mm, respectively, for the overlap nip (s) and tension nip (t) and so as to limit the spare nip (u) desirably to 0.5 mm as with the first and second embodiments.

Images were checked by actually using the image forming apparatus and it was confirmed that primary transfer property equal to those of the first embodiment were available. However, the third embodiment is distinguished from the first embodiment in that the raised filament portion 5α on the upstream end of the primary transfer brush 5 is made substantially rectilinear by welding. In the first embodiment, the raised filament portion 5α on the upstream end of the primary transfer brush 5 is made substantially rectilinear by cutting. However, during paper feed testing of the image forming apparatus, in some cases, the conductive filaments 5ε gradually separated from the base fabric portion 5β and fell off. In contrast, it was confirmed that the configuration of the third embodiment was able to secure good primary transfer property throughout the lifetime of the image forming apparatus.

Also, in a separated state (state in which no pressure is applied to the filaments), the raised filament portion 5α of the primary transfer brush 5 used in the third embodiment is raised perpendicularly to a seat 5δ of the primary transfer brush 5. However, a raised filament portion 5α raised by maintaining a tilt angle θ to the seat 5δ of the primary transfer brush 5 may be used as in the case of the second embodiment. In that case, it goes without saying that better primary transfer property than the third embodiment can be maintained throughout the lifetime of the image forming apparatus.

For the reasons described above, even if there are variations in component mounting locations of the image forming apparatus, the third embodiment can maintain good primary transfer property throughout the lifetime of the image forming apparatus using the primary transfer brush 5 in which the upstream end of the raised filament portion 5α is fusion-bonded substantially rectilinearly.

In the first to third embodiments, description has been given of the configuration of the primary transfer portion in a full-color tandem image forming apparatus which is based on an intermediate transfer method and equipped with an intermediate transfer belt 6. However, a full-color rotary image forming apparatus equipped with a single photosensitive drum can also provide good transfer property if configured according to the present invention.

Also, as an image forming apparatus in which the primary transfer brush 5 is abutted against the image bearing member through the intermediate transfer belt 6, an image forming apparatus of another configuration is conceivable. Examples include a full-color image forming apparatus in which toner images on plural photosensitive drums are transferred one after another onto transfer material transported on a transfer belt. This configuration provides good transfer property if configured according to the present invention.

While the present invention has been described with reference to embodiments, it is to be understood that the invention is not limited to the disclosed embodiments.

This application claims the benefit of Japanese Patent Applications No. 2012-270666, filed Dec 11, 2012, No. 2012-270667, filed Dec. 11, 2012, and No. 2013-166438, filed Aug. 9, 2013, which are hereby incorporated by reference herein in their entirety.

What is claimed is:

1. An image forming apparatus comprising:

an image bearing member adapted to bear a toner image;

a transfer belt that is movable; and a transfer device adapted to transfer the toner image from the image bearing member to the transfer belt, the transfer device positioned on the opposite side of the transfer belt from the image bearing member, the transfer device including a brush member having a plurality of conductive filaments arranged to contact the transfer belt and a holding portion, wherein each of a plurality of filament bundles is formed as a bundle of conductive filaments which are a part of the plurality of conductive filaments, the plurality of filament bundles being arranged on the holding portion, and wherein in each line along a moving direction of the transfer belt among lines of the plurality of filament bundles, a filament bundle located on a most upstream side of the brush member with respect to the moving direction is partially cut off.

2. An image forming apparatus according to claim 1, wherein in each line along the moving direction of the transfer belt among the lines of the plurality of filament bundles, conductive filaments located on the most upstream side of the brush member with respect to the moving direction in a filament bundle located on the most upstream side with respect to the moving direction are arranged substantially in a line along a direction perpendicular to the moving direction of the transfer belt.

3. An image forming apparatus according to claim 1, wherein the transfer device includes a supporting member adapted to support the brush member; and wherein an upstream end of the brush member with respect to the moving direction is located downstream with regard to an upstream end of the supporting member.

4. An image forming apparatus according to claim 3, wherein the supporting member includes a resin seat, one end of which is fixed and another end of which is free.

5. An image forming apparatus according to claim 3, wherein the supporting member includes a metal plate.

6. An image forming apparatus according to claim 3, further comprising an urging member adapted to urge the brush member toward the image bearing member through the supporting member.

7. An image forming apparatus according to claim 1, wherein the transfer belt comprises an intermediate transfer belt to which the toner image is transferred from the image bearing member.

8. An image forming apparatus according to claim 1, wherein the holding portion includes a base fabric portion formed of a plurality of strings; and wherein the filament bundles comprise a plurality of conductive filaments woven between the strings.

9. An image forming apparatus comprising:

an image bearing member adapted to bear a toner image;

a transfer belt that is movable; and a transfer device adapted to transfer the toner image from the image bearing member the transfer belt, the transfer device being positioned on the opposite side of the transfer belt from the image bearing member, the transfer device including a brush member having a plurality of conductive filaments arranged to contact the transfer belt, wherein the conductive filaments, among the plurality of conductive filaments of the brush member, which are located towards an upstream end of the brush member, with respect to a moving direction of the transfer belt, are bonded.

10. An image forming apparatus according to claim 9, wherein the conductive filaments include fusion-bonded conductive filaments.

11. An image forming apparatus according to claim 9, wherein the brush member includes a holding portion and a plurality of filament bundles, each of which is formed as a bundle of conductive filaments which are a part of the plurality of conductive filaments; and the plurality of filament bundles are arranged on the holding portion.

12. An image forming apparatus according to claim 11, wherein in each line along the moving direction of the transfer belt among lines of the plurality of filament bundles, the filament bundle located on the most upstream side with respect to the moving direction is fusion-bonded, and the filament bundle and another filament bundle adjacent to the filament bundle in a direction perpendicular to the moving direction of the transfer belt are fusion-bonded with each other.

13. An image forming apparatus according to claim 11, wherein conductive filaments located on the most upstream side with respect to the moving direction in a filament bundle located on the most upstream side with respect to the moving direction are fusion-bonded and arranged substantially in a line along a direction perpendicular to the moving direction of the transfer belt.

14. An image forming apparatus comprising:

an image bearing member adapted to bear a toner image;

a transfer belt that is movable; and a transfer device adapted to transfer the toner image from the image bearing member to the transfer belt, the transfer device positioned on the opposite side of the transfer belt from the image bearing member, the transfer device including a brush member and a supporting member adapted to support the brush member, the brush member having a plurality of conductive filaments arranged to contact the transfer belt, wherein conductive filaments, among the plurality of conductive filaments of the brush member, which are located towards an upstream end of the brush member, with respect to the moving direction of the transfer belt, are cut along a direction perpendicular to a moving direction of the transfer belt, and wherein the upstream end of the brush member with respect to the moving direction is located downstream with regard to an upstream end of the supporting member.

15. An image forming apparatus according to claim 14, wherein the supporting member includes a resin seat, one end of which is fixed and another end of which is free.

16. An image forming apparatus according to claim 14, wherein the supporting member includes a metal plate.

17. An image forming apparatus according to claim 14, further comprising an urging member adapted to urge the brush member toward the image bearing member through the supporting member.

* * * * *